United States Patent [19]

Meisenheimer, Jr.

[11] 4,110,575

[45] Aug. 29, 1978

[54] SPOOL DEFLECTION INDICATOR

[76] Inventor: Daniel T. Meisenheimer, Jr., 404 Longmeadow Rd., Orange, Conn. 06477

[21] Appl. No.: 700,391

[22] Filed: Jun. 28, 1976

[51] Int. Cl.[2] ..... H01H 35/00

[52] U.S. Cl. ..... 200/81.9 R; 200/153 T

[58] Field of Search ..... 200/6 A, 61.24, 61.44, 200/81 R, 81.9 R, 81.9 M, 82 R, 82 D, 82 C, 83 R, 83 B, 83 S, 153 T, 332, 61.48, 61.52

[56] References Cited

U.S. PATENT DOCUMENTS

| | | | |
|---|---|---|---|
| 2,211,553 | 8/1940 | Bogue | 200/81.9 R |
| 2,583,814 | 1/1952 | Burklin | 200/81.9 R X |
| 2,640,977 | 6/1953 | Parisi | 200/83 B X |
| 2,734,106 | 2/1956 | Riley et al. | 200/81.9 R |
| 2,768,256 | 10/1956 | Barecki et al. | 200/153 T |
| 2,852,635 | 9/1958 | Reed | 200/81.9 R |
| 3,194,916 | 7/1965 | Vischer, Jr. | 200/83 S |
| 3,501,605 | 3/1970 | Hutchinson et al. | 200/81.9 R |
| 3,739,119 | 6/1973 | Rike | 200/81.9 R X |
| 3,922,515 | 11/1975 | Meisenheimer, Jr. | 200/153 T X |

*Primary Examiner*—James R. Scott
*Attorney, Agent, or Firm*—Wooster, Davis & Cifelli

[57] ABSTRACT

A spool deflection indicator comprising a shank and an integral enlarged switch housing supporting a switch. The shank pivotally supports a rod which is connected at one end to a horizontally movable spool located below the indicator. The other end of the rod opposite the spool has a cam with a concave indentation. The concave indentation is aligned with a switch button on the switch. When the spool moves, the cam also moves causing the concave indentation to become misaligned with the switch button thereby depressing it and changing the mode of the switch.

13 Claims, 5 Drawing Figures

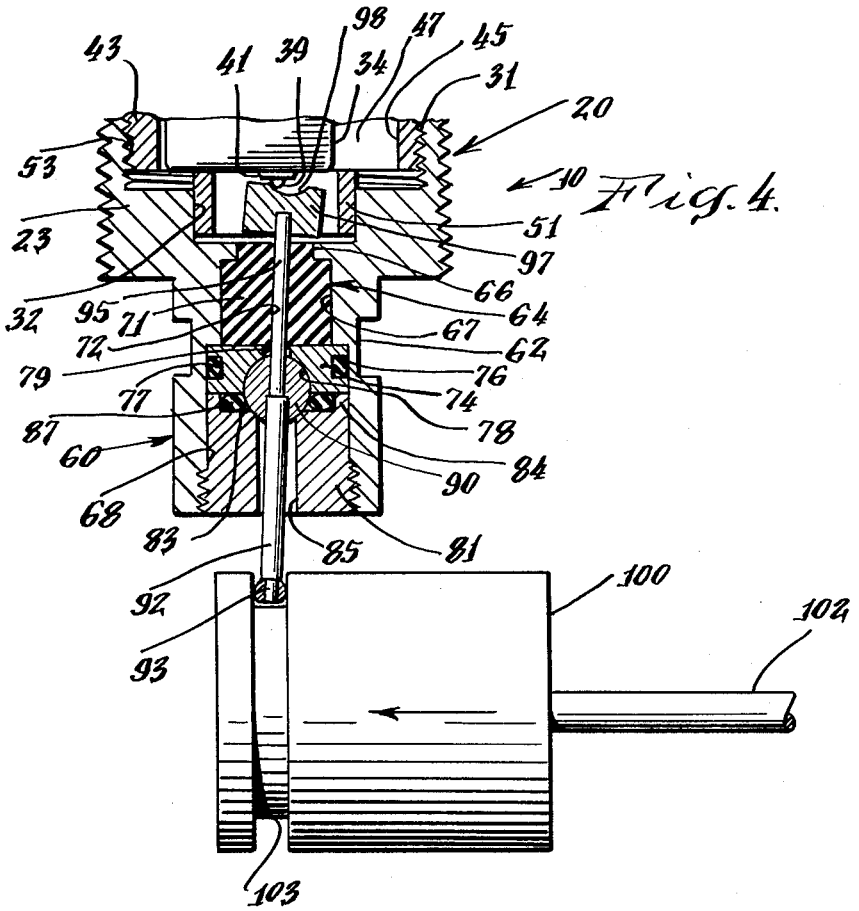
Fig. 4.
Fig. 5.
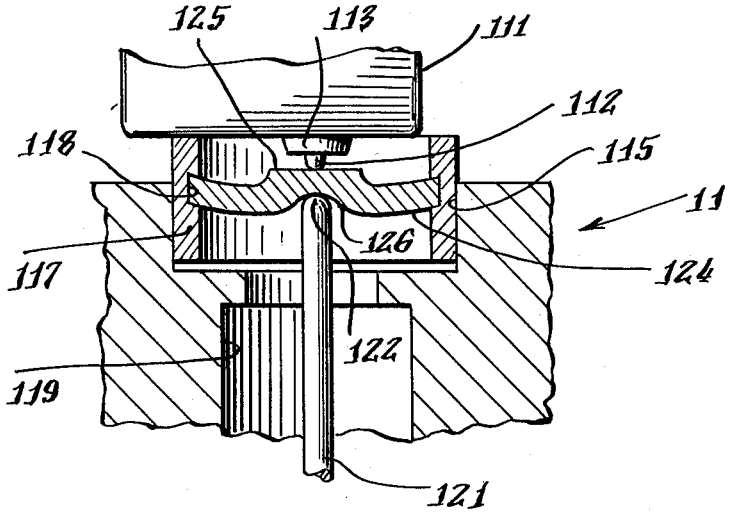

SPOOL DEFLECTION INDICATOR

BACKGROUND OF THE INVENTION

This invention relates to a spool deflection indicator which is used to electrically indicate the change in position of a spool or piston. Such a spool deflection indicator is used in different types of control systems and has particular applicability to those found in aircraft.

The spool deflection indicator generally employs a standard switch which operates by depressing a switch button. Because of the manner in which the spool deflection indicators are used, the switch must change modes, thereby passing the proper signal, each and every time the spool moves beyond a certain specified distance in either direction. The allowable distance is usually very small and, therefore, the spool deflection indicator must reliably transfer this very small movement of the spool to the switch button so that it is depressed. Due to the fact that the spool deflection indicator may be used as part of an aircraft control system, reliability is of paramount importance.

As the distance required for the spool to travel before it triggers the switch is not the same in different control systems, it is desirable that the particular indicator be easily adjustable so that the same type can be used in a variety of situations. Along this same line, it may also be very useful in any particular instance to be able to adjust the sensitivity of an individual unit. Furthermore, since the spool and at least a portion of the indicator are generally immersed in a fluid under pressure, the spool deflection indicator must also reliably operate under these same conditions and be sealed to prevent leakage. These factors increase the design problems encountered in this area.

As a result of the degree of accuracy needed and the miniscule action upon which operation depends, along with the other design factors, no known prior art spool deflection indicator successfully meets the requirements of sensitivity and reliability which are demanded.

SUMMARY OF THE INVENTION

The spool deflection indicator according to the invention herein is very dependable and capable of translating a very slight movement by a spool or a piston into an electrical signal upon each and every occurrence of the movement. In addition, the sensitivity of the indicator can be adjusted as desired.

The spool deflection indicator comprises an enlarged switch housing having an integral shank which is centrally disposed on the bottom of the housing. The enlarged switch housing is hollow and supports a standard switch which operates by depressing a switch button. The switch is positioned inside the enlarged switch housing in such a manner that the switch button is centrally disposed inside the spool deflection indicator adjacent to the shank.

A rod axially aligned with the switch housing and the shank extends through the shank from near the switch button to a spool outside of the shank. The rod is pivotally supported by the shank so that a movement in one end of the rod will produce a similar movement in the opposite direction in the other end of the rod. The pivot point remains fixed inside the shank. A cam having a concave depression in its top is disposed on the end of the rod opposite the spool so that the concave depression surrounds the switch button. As a result, any horizontal movement in the spool will cause a corresponding movement in the opposite direction in the end of the rod with the cam. The concave depression of the cam will thereby move away from center and the switch button and as the movement continues the button will be increasingly depressed until it activates the switch.

The relative sensitivity of the spool deflection indicator can be altered by adjusting inside the enlarged switch housing the longitudinal location of the switch thereby changing the distance between the switch button and the cam. As the button is moved away from the cam, a greater movement by the spool is required to depress it, and conversely, the sensitivity is increased by narrowing the distance between the button and the cam.

Accordingly, a principal object of the present invention is to provide a spool deflection indicator which operates by a very small movement of a spool.

Another object of the present invention is to provide a spool deflection indicator which is adjustable.

Another object of the present invention is to provide a spool deflection indicator which is very reliable.

Other and more specific objects of the invention will be in part obvious and will in part appear from the following description of the preferred embodiment and claims taken together with the drawings.

DRAWINGS

FIG. 4 is a cut away view of the lower portion of the spool deflection indicator after the spool has moved from its normal position, and FIG. 5 is an enlarged cut away view of a portion of another spool deflection indicator.

The same reference numbers refer to the same elements throughout the various Figures.

DESCRIPTION OF THE PREFERRED EMBODIMENT

Figure 1:
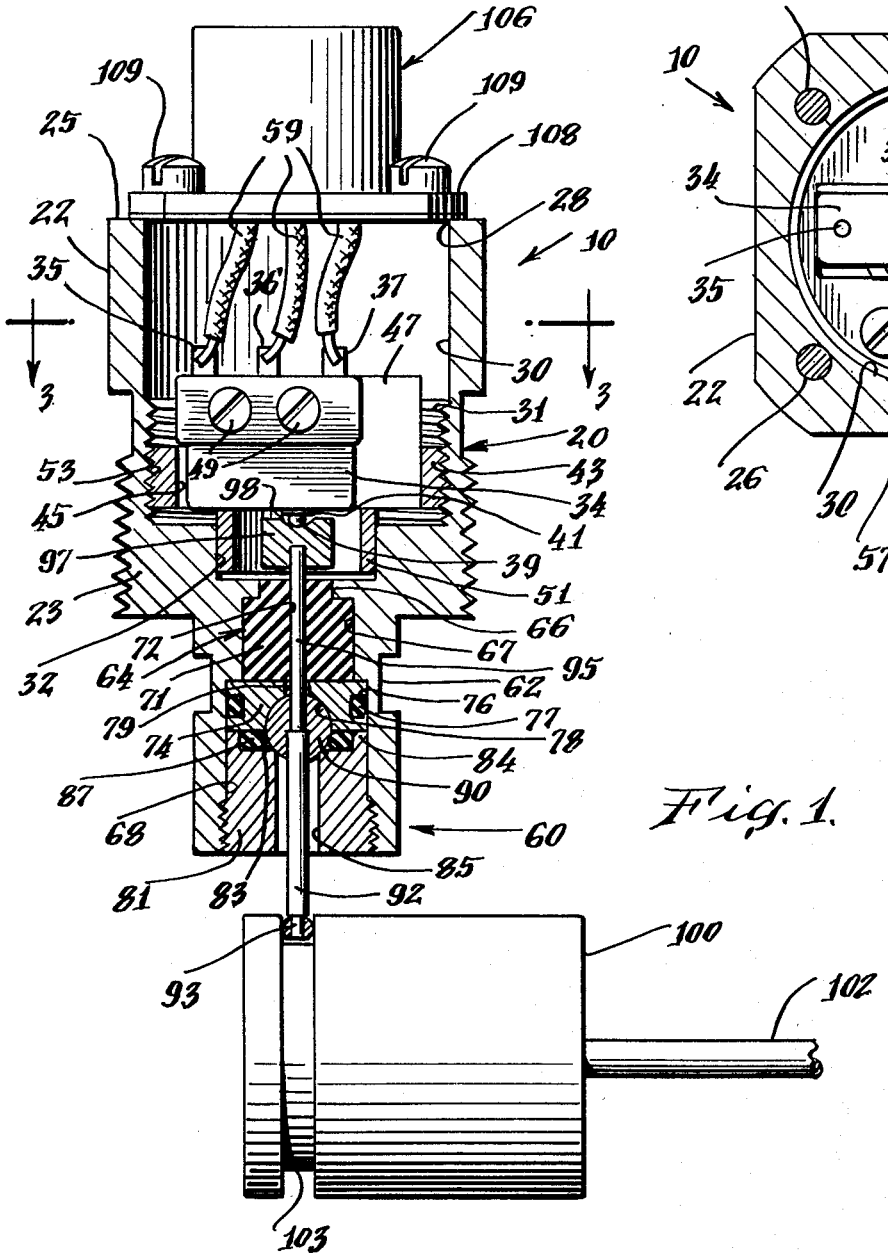
FIG. 1 is a cut away view of the spool deflection indicator according to the invention herein connected to a spool.

Referring now to FIG. 1, a spool deflection indicator according to the invention herein is shown at 10. The spool deflection indicator 10 is generally comprised of two main elements which are an enlarged switch housing 20 and a shank 60 which is integral with and centrally disposed on the bottom of the switch housing 20.

As shown in FIG. 1, the enlarged switch housing 20 is comprised of an upper rectangular head 22 and an integral lower cylindrical section 23 which is longitudinally aligned with the upper rectangular head 22. The upper rectangular head 22 has a substantially square top plate 25 at one end opposite the cylindrical section 23 and a series of four screw holes 26 disposed near each corner extend from the top plate 25 to near the bottom of the rectangular head 22. The top plate 25 also has a centrally disposed, circular wiring opening 28 having a diameter slightly smaller than the outside diameter of the lower cylindrical section 23. A cylindrical switch compartment 30 extends from the wiring opening 28 through the entire rectangular head 22 to the approximate midpoint of the lower cylindrical section 23. The switch compartment 30, which has the same diameter as the wiring opening 28, is longitudinally aligned with the enlarged switch housing 20, and screw threads 31 are disposed on that portion of the switch compartment 30 inside the lower cylindrical section 23.

The lower cylindrical section 23 extends from the rectangular head 22 to the bottom of the enlarged switch housing 20 and all of the outside of the lower cylindrical section 23 except for that portion closest to the rectangular head 22 is screw threaded, as shown in FIG. 1.

A small cylindrical cam compartment 32 having a smaller diameter than the switch compartment 30 is located inside the lower cylindrical section 23. The cam compartment 32 is concentrically aligned with the switch compartment 30 and extends from the switch compartment 30 to almost the bottom of the enlarged switch housing 20.

A standard electrical switch 34 is used with the spool deflection indicator 10. The switch 34 has a series of three terminals 35–37 which are spaced apart on the top of the switch 34. A switch button 39 is disposed off center on the bottom of the switch 34 opposite the terminals 35–37. The switch button 39 protrudes through a small washer 41 when the button 39 is not depressed.

This standard switch 34 operates in the following manner. An electrical circuit initially exists internally in the switch 34 between the first terminal 35 and the second terminal 36. When the switch button 39 is depressed, this circuit is broken, but at the same time, a circuit between the first terminal 35 and the third terminal 37 is completed. If the switch button 39 is again depressed, the first terminal 35 is reconnected to the second terminal 36. Therefore, an input current on the first terminal 35 will be directed to one of the other terminals depending upon the operational mode of the switch.

Figure 3:
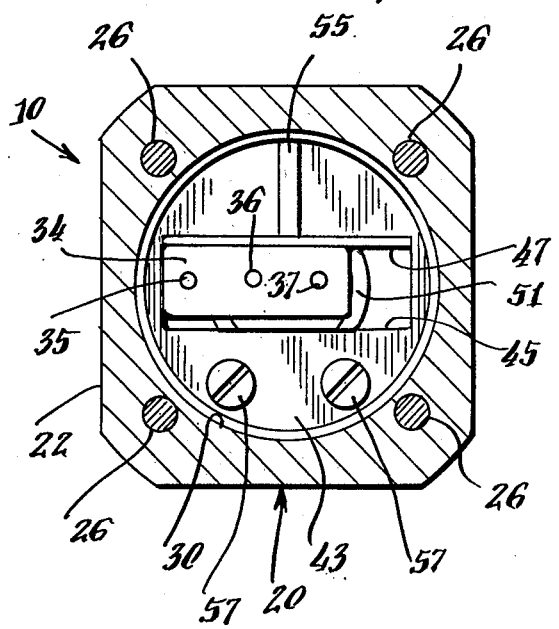
FIG. 3 is a cross-sectional view taken along lines 3—3 of FIG. 1.

The switch 34 is mounted on a flat circular collar 43 having a rectangular switch opening 45, as best shown in FIG. 3. A rectangular support plate 47 which extends perpendicularly upward from the top of the collar 43 is disposed along the longitudinal edge of the rectangular switch opening 45. The switch 34 is fitted into one end of the rectangular switch opening 45 adjacent to the support plate 47 so that the switch button 39 is centrally disposed with respect to the collar 43. At the same time, the top of the switch 34 is aligned with the top of the support plate 47 and the bottom of the switch 34 is aligned with the bottom of the collar 43. When the switch 34 is so positioned, it is secured to the support plate 47 by a pair of flat head screws 49 which pass entirely through the switch 34 and into the support plate 47.

A switch button cylinder 51 having a smaller diameter than the collar 43 and an open top and bottom is concentrically aligned with and disposed on the bottom of the collar 43. As shown in FIG. 1, the switch button cylinder 51 surrounds the centrally disposed switch button 39 when the switch 34 is in place. Screw threads 53 are disposed on the outside of the collar 43. When the collar 43 is in place, as shown in FIG. 1, the threads 53 of the collar 43 mate with the screw threads 31 of the lower portion of the switch compartment 30 of the enlarged switch housing 20, and the switch button cylinder 51 on the bottom of the collar 43 fits snugly into the cam compartment 32, thereby centering the switch button therein.

As shown in FIG. 3, the collar 43 has a turning bar 55 which extends perpendicularly from the support plate 47 to the edge of the collar 43 disposed on its top surface. The turning bar 55 provides a convenient grip for rotating the collar 43. Because of the screw threads 32, 53, rotation of the properly mounted collar 43 will cause the collar 43 and the switch 34 along with the switch button cylinder 51 to move towards or away from the bottom of the cam compartment 32 depending upon the direction of the rotation.

The collar 43 is secured inside the enlarged switch housing 20 and rotation is prevented by a pair of collar securing screws 57. As shown in FIG. 3, the collar securing screws 57 are located to the side of the rectangular switch opening 45 opposite the support plate 47. The collar securing screws 57 pass through the collar 43, butting against the portion of the cylindrical section 23 below the switch compartment 30 and thereby securing the collar 43 to the enlarged switch housing 20. The collar 43 cannot be rotated without releasing the securing screws 57. When the collar 43 is secured in this manner, separate wires 59 are connected to each of the terminals 35–37 of the switch 34. The wires 59 from each of the terminals 35–37 are then run up through the wiring opening 28 in the top plate 25 of the rectangular head 22.

The cylindrical shank 60 having an annular groove 62 is integral with the bottom of the enlarged switch housing 20. The shank 60 has a smaller diameter than the lower cylindrical portion 23, and both the shank 60 and the cylindrical portion are concentrically aligned.

A bore 64 extends through the entire shank 60 to the cam compartment 32 of the lower cylindrical section 23. The bore 64 is concentrically aligned with the cam compartment 32 and the switch compartment 30. The bore 64 is sharply stepped having a top section 66, a middle section 67 and a bottom section 68. The top section 66 of the bore 64 has the smallest diameter and extends approximately half the distance from the cam compartment 32 to the bottom of the enlarged switch housing 20. The middle section 67 having a slightly larger diameter than the top section 66 of the bore 64 extends from the top section 66 to the approximate midpoint of the annular groove 62 of the shank 60, and bottom section 68 having a larger diameter than that of the middle section 67 extends from the middle section 67 to the end of the shank 60 opposite the enlarged switch housing 20. The bottom section 68 is partially screw threaded at the end opposite the middle section 67.

A flexible centering bushing 71 having the shape of the top section 66 and middle section 67 of the bore 64 is snugly disposed therein and extends from the cam compartment 32 to the bottom section 68, as shown in FIGS. 1 and 4. The centering bushing 71 has a centrally disposed rod hole 72 extending therethrough which is longitudinally aligned with the switch button 39.

A cylindrical ball socket collar 74 of stainless steel or other similar material is inserted in the bottom section 68 of the bore 64 adjacent to and just below the centering bushing 71. The ball socket collar 74 has an annular groove 76 into which is fit a first O-ring seal 77 which creates a leakproof seal between the ball socket collar 74 and the shank 60. The ball socket collar 74 has a partial semispherical cup 78 centrally disposed in its bottom surface so that the cup 78 is directed downward toward the end of the shank 60 opposite the enlarged switch housing 20. A collar rod hole 79 extends from the apex of the semispherical cup 78 through the ball socket collar 74 to the centering bushing 71 so that the collar rod hole 79 is concentrically aligned with the centering bushing rod hole 72. The rod hole 79 of the ball socket collar 74 has a slightly greater diameter than the rod hole 72 of the centering bushing 71.

A cylindrical plug 81 having a top surface 83 is mounted inside the remaining portion of the bottom section 68 of the bore 64 which extends from the ball socket collar 74 to the end of the shank 60 opposite the enlarged switch housing 20. The lower part of the plug 81 is screw threaded and mates with the screw threads of the bottom section 68 of the bore 64.

A wall 84 is peripherally disposed on the top surface 83 of the plug 81, and the wall 84 contacts the ball socket collar 74 when the plug 81 is in place. A centrally disposed rod hole 85 extends from the top surface 83 to the end of the plug 81 opposite the ball socket collar 74. The rod hole 85 of the plug 81 is aligned with and has a greater diameter than the collar rod hole 79. A second O-ring seal 87 is disposed on the top surface 83 of the plug 81 inside the wall 84. The second O-ring seal 87 forms a leakproof seal between the plug 81 and the ball socket collar 74.

A ball 90 movably rests inside the semispherical cup 78 of the ball socket collar 74. The ball 90 is held in place by the second O-ring seal 87 and the plug 81. The second O-ring seal 87 also creates a leakproof seal with the ball 90, which effectively seals against leaks at pressures in excess of 4000 psi, and yet permits low-friction rotation of ball 90. The ball 90 is free to rotate, but cannot move laterally or longitudinally inside the shank 60.

One end of a spool rod 92 is attached to the ball 90. The spool rod 92 extends from the ball 90 through the rod hole 85 of the plug 81 to outside of the shank 60. As the diameter of the spool rod 92 is considerably less than the diameter of the rod hole 85 of the plug 81, the spool rod 92 can be moved within the rod hole 85, which will also cause a rotation in the ball 90. A knob 93 is disposed on the lower end of the spool rod 92 opposite the ball 90.

One end of a cam rod 95 which is axially aligned with the spool rod 92 is attached to the ball 90 opposite the spool rod 92. The cam rod 95 extends from the ball 90 through the collar rod hole 79 and the centering bushing rod hole 72 and into the cam compartment 32, as shown in FIG. 1. The diameter of the centering bushing rod hole 72 is such that it snugly accommodates the cam rod 95.

A cam 97 is mounted on the end of the cam rod 95 in the cam compartment 32. The cam 97 has a centrally disposed concave indentation 98 in its top surface. When the cam 97 is in place under static conditions, the switch button 39 is aligned with the apex of the concave indentation 98 and actually extends below the top surface of the cam 97 and into the concave indentation 98, as shown in FIG. 1.

When the spool deflection indicator 10 is installed in a control system, a cylindrical spool 100 is located below it. As shown in FIG. 1, the longitudinal axis of the spool 100 is in a plane perpendicular to the longitudinal axis of the spool deflection indicator 10. The spool 100 has a centrally disposed spool shaft 102 extending from one end. An annular groove 103 is disposed on the spool 100 near its end opposite the spool shaft 102 and the annular groove 103 receives the knob 93 of the spool rod 92 when the spool deflection indicator 10 is in place. The spool 100 which can move horizontally along an extension of its longitudinal axis is usually supported in a fluid such as hydraulic oil, and at least some portion of the shank 60 will also be in the same medium as the spool 100. Although the shank 60 has a number of separate parts, the two O-ring seals 77, 87 effectively seal all possible fluid passages and prevent any leakage.

Referring now to FIG. 4, the installed spool deflection indicator 10 operates in the following manner. When the spool 100 moves forward, the knob 93 of the spool rod 92 is also pushed forward thereby moving the spool rod 92 and rotating the ball 90. The ball 90 acts as a pivot point for the two rods 92, 95 and the rotation of the ball 90 causes a movement in the cam rod 95 and the cam 97 in the opposite direction as that of the spool 100 and spool rod 92. As a result of this movement of the cam 97, the concave indentation 98 of the cam 97 moves away from the switch button 39 thereby causing the effective depth of the concave indentation 98 to become less with respect to the switch button 39. The side of the concave indentation 98 increasingly presses on the switch button 39 as the tilt of the cam 97 increases with the distance moved by the spool 100 until the button 39 triggers the switch 34. A signal is then sent as previously explained.

After the spool 100 has returned to its original position, the flexible centering bushing 71 will act to exert a force on the cam rod 95 which fits tightly in the centering bushing rod hole 72 and restore the cam rod 95 to its original central position. This also properly positions the cam 97 and the concave indentation 98 with respect to the switch button 39. The operation is the same when the spool 100 moves rearward.

The relative sensitivity of the spool deflection indicator 10 can be easily adjusted by rotating the collar 43 supporting the switch 34 inside the enlarged switch housing 20. As previously explained, this rotation causes the switch 34 and the switch button 39 to move upward or downward with respect to the cam compartment 32. The switch button 39 remains centrally disposed, but the height of the switch button 39 with respect to the concave indentation 98 of the cam 97 is changed. If the switch button 39 is moved away from the concave indentation 98, the spool 100 must move a greater distance before the cam 97 tilts sufficiently to depress the switch button 39. If on the other hand the collar 43 is rotated so that the switch button 39 is closer to the concave indentation 98 of the cam 97, less movement by the spool 100 is required and the sensitivity of the spool deflection indicator 10 is increased. Therefore, the same spool deflection indicator according to this invention can be used in different control systems by making only a minor adjustment.

Figure 2:
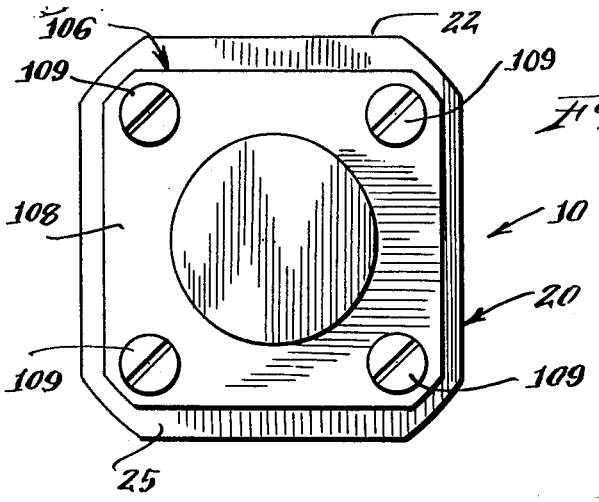
FIG. 2 is a top view of the spool deflection indicator of FIG. 1.

When the spool deflection indicator 10 is in place, a connector 106 is attached over the wiring opening 28 of the top plate 25 of the rectangular head 22. The wires 59 from the switch terminals 35–37 are run through the wiring opening 28 and through the connector 106. The connector 106 has a substantially square connector plate 108, as shown in FIG. 2, having four screw holes (not shown) which align with the screw holes 26 of the enlarged switch housing 20. The connector 106 is secured to the spool deflection indicator 10 by four screws 109 which pass through the connector plate 108 and into the screw holes 26.

Another embodiment of this invention is shown in FIG. 5. A switch 111 having a switch button 112 surrounded by a washer 113 is mounted in a spool deflection indicator 11 in the same manner as in the previous embodiment. The switch button 112 is centrally disposed in the spool deflection indicator 11 in the direction of a cam compartment 115. A switch button cylinder 117 is centrally disposed on a collar (not shown) which supports the switch 111. The switch button cylinder 117 has an internal annular groove 118 and an open top and bottom. The switch button cylinder 117 fits snugly inside the cam compartment 115. A bore 119 extends to the cam compartment 115 and a cam rod 121 is centrally disposed in the bore 119. The cam rod 121 having a rounded top 122 is connected to a spool (not shown) in the same manner as in the previous embodiment.

A circular flexible cam 124 fits into and is supported by the annular groove 118 of the switch button cylinder 117. The flexible cam 124 has a flat top surface 125 which contacts the switch button 112. A concave cam surface 126 is centrally disposed on the bottom of the cam 124 opposite the flat top surface 125. As shown in FIG. 5, the rounded top 122 of the cam rod 121 fits into and centers with the concave cam surface 126.

In operation, the rod 121 will move when the spool moves as in the previous embodiment. The top 122 of the rod 121 will then move away from the apex of the concave cam surface 126 thereby forcing the cam 124 and its top surface 125 upward. This upward movement of the cam 124 will depress the switch button 112 triggering the switch 111. Because the flexible cam 124 is biased downwardly, the rod 121 will be recentered when the spool returns to its original position. As the cam does not exert any shear force on the switch button in this embodiment, damage to the switch button may be avoided.

From the foregoing description of the invention and the discussion of the prior art, the numerous advantages and improvements incident to this invention will now be apparent to those skilled in the art.

Accordingly, the above description of the invention is to be construed as illustrative only rather than limiting. The invention is limited only by the scope of the following claims.

I claim:

1. An indicator for sensing deflection of a spool or the like comprising:

(A) a housing adapted for mounting adjacent to a deflectable spool or the like, said housing defining an opening disposed toward the spool;

(B) signal producing means including an axially depressible actuating member thereof, said signal producing means mounted in said housing with the actuating member disposed toward said housing opening and said spool;

(C) a rod pivotally mounted at a point intermediate its ends and in said housing, one end of said rod extending from said housing through said housing opening for engagement with said spool whereby deflection of said spool pivots said rod, and the other end of said rod extending toward and generally aligned with the actuating member of said signal producing means; and (D) a cam mounted on the end of said rod extending toward said actuating member of said signal producing means, said cam defining a cam surface which is positioned adjacent to and engages and acts on said actuating member of said signal producing means, whereby pivoting of said rod by deflection of said spool moves said cam surface with respect to said actuating member and causes said signal producing means to produce a signal in response to deflection of said spool.

2. An indicator for sensing deflection of a spool or the like as defined in claim 1 wherein said signal producing means comprises an electrical switch including a depressible switch button as the actuating member thereof.

3. An indicator for sensing deflection of a spool or the like as defined in claim 2 wherein said cam defines a concave cam surface and said switch button is positioned centrally with respect to said concave cam surface when said spool is undeflected.

4. An indicator for sensing deflection of a spool or the like as defined in claim 1 wherein the actuating member of said signal producing means is adjustably mounted in said housing with respect to the cam surface defined by said cam, whereby adjustment of said actuating member toward or away from said cam surface alters the amount of deflection of said spool and consequent pivoting of said rod and movement of said cam surface which is necessary to cause said signal producing means to produce a signal, thereby adjusting the sensitivity of the indicator.

5. An indicator for sensing deflection of a spool or the like as defined in claim 4 wherein said signal producing means comprises an electrical switch including a depressible switch button as the actuating member thereof.

6. An indicator for sensing deflection of a spool or the like as defined in claim 5 wherein said cam defines a concave cam surface and said switch button is positioned centrally with respect to said concave cam surface when said spool is undeflected.

7. An indicator for sensing deflection of a spool or the like as defined in claim 5 wherein said switch and switch button thereof are mounted on a collar threadably received in said housing, whereby rotation of said collar adjustably positions said switch button with respect to said cam.

8. An indicator for sensing deflection of a spool or the like as defined in claim 7 wherein said collar includes a cylindrical flange and said housing defines a cylindrical surface matingly receiving said cylindrical flange, the cooperation of said cylindrical flange with said cylindrical housing surface precisely centering said switch button therein.

9. An indicator for sensing deflection of a spool or the like as defined in claim 3 and further comprising a flexible centering bushing, wherein said flexible bushing is cylindrical and defines a rod opening axially disposed therethrough, and said housing defines a cylindrical surface matingly receiving said flexible bushing, and said rod is partially disposed in said flexible bushing, wherein said bushing biases said rod to a central position absent a deflecting load on said rod.

10. An indicator for sensing deflection of a spool or the like as defined in claim 1 wherein said rod is pivotally mounted by means of a ball secured intermediate its length, said ball partially received in a semispherical cup defined by a ball socket collar mounted in said housing, said ball socket collar also defining an opening therethrough from said semispherical cup for accommodating the portion of the rod on one side of said ball and movement thereof, said ball rotatably held against said semispherical cup by a plug mounted in said housing opposite said ball socket collar, said plug having a central rod hole through which the portion of said rod on the other side of said ball movably extends, said rod thereby being pivotally mounted in said housing such that any motion in the spool end of said rod will cause said ball to rotate and produce a movement in the opposite end of said rod and the cam mounted thereto, and wherein said spool is mounted in a fluid system enclosed by a fluid system housing, the fluid of said system causing the deflection of said spool, said indicator housing being mounted to said fluid system housing such that one end of said rod is engaged with said spool, and wherein said plug is provided with a shoulder adjacent said ball and opposite said ball socket collar, and further comprising an O-seal positioned on said shoulder and engaging said plug, ball socket collar and ball to prevent fluid from said fluid system to pass thereby.

11. An indicator for sensing deflection of a spool or the like comprising:

(A) a housing adapted for mounting adjacent to a deflectable spool or the like, said housing defining an opening disposed toward the spool;

(B) signal producing means including a depressible actuating member thereof, said signal producing means mounted in said housing with the depressible actuating member disposed toward said housing opening and said spool;

(C) a rod pivotally mounted at a point intermediate its ends and in said housing, the first end of said rod extending from said housing through said housing opening for engagement with said spool whereby deflection of said spool pivots said rod, and the second end of said rod extending toward and generally aligned with the depressible actuating member of said signal producing means; and (D) a flexible cam member mounted in said housing and interposed between said depressible actuating member and the second end of said rod, said flexible cam member having a top which contacts said depressible actuating member and a bottom which defines a concave cam surface in which the end of said rod is received, whereby pivoting of said rod by deflection of said spool moves the second end of the rod against the concave cam surface, thereby driving said flexible cam member against said actuating member and causing said signal producing means to produce a signal.

12. An indicator for sensing deflection of a spool or the like as defined in claim 11 wherein said flexible cam member is resilient and resiliently biased toward the second end of said rod, whereby said flexible cam member centers said rod in said concave cam surface absent deflection of said spool.

13. Apparatus for sealingly pivotally mounting a rod extending into a pressurized fluid-filled system wherein said system defines an opening accommodating the rod, the apparatus comprising:

(A) a housing attached to the pressurized fluid-filled system, said housing defining an opening in communication with the opening defined in said pressurized fluid-filled system;

(B) a rod disposed in the opening defined in said housing, first end of said rod extending into said fluid-filled system;

(C) a non-resilient ball rigidly mounted intermediate and surrounding said rod;

(D) A non-resilient ball socket collar mounted in the opening in said housing, said ball socket collar defining a concave partial semispherical surface facing the opening in said fluid-filled system and pivotally receiving said ball, said ball socket collar defining an opening therethrough surrounded by said partial semispherical surface and through which the second end of said rod extends;

(E) a ball retaining plug mounted in the opening in said housing juxtaposed said ball socket collar, said ball retaining plug engaging said ball and holding it against said ball socket collar, said ball retaining plug defining an opening therethrough accommodating the first end of said rod extending into said pressurized fluid-filled system, said ball socket collar and said ball retaining plug defining a groove adjacent and surrounding said ball; and (F) a resilient O-seal position in said groove and surrounding said ball, whereby said O-seal engages said ball and said ball socket collar to prevent fluid leakage from said fluid-filled system and permits low-friction pivoting of said ball and rod mounted thereto.

* * * * *